US007507105B1

(12) United States Patent
Peters et al.

(10) Patent No.: US 7,507,105 B1
(45) Date of Patent: Mar. 24, 2009

(54) HAZARDOUS AREA COUPLER DEVICE

(75) Inventors: Mark Peters, Hamilton, OH (US); Robert Fitzpatrick, Cincinnati, OH (US)

(73) Assignee: Ventek, LLC, West Chester, OH (US)

( * ) Notice: Subject to any disclaimer, the term of this patent is extended or adjusted under 35 U.S.C. 154(b) by 0 days.

(21) Appl. No.: 11/779,056

(22) Filed: Jul. 17, 2007

(51) Int. Cl.
*H01R 13/64* (2006.01)

(52) U.S. Cl. ..... 439/374

(58) Field of Classification Search ..... 439/374, 439/581, 63; 174/76
See application file for complete search history.

(56) References Cited

U.S. PATENT DOCUMENTS

| | | | | |
|---|---|---|---|---|
| 6,980,174 | B2 * | 12/2005 | Flasza et al. | 343/850 |
| 7,057,577 | B1 | 6/2006 | Willoughby et al. | |
| 2004/0183744 | A1 * | 9/2004 | Raiman | 343/906 |
| 2004/0194994 | A1 * | 10/2004 | Rasmussen | 174/76 |

* cited by examiner

*Primary Examiner*—Jean F Duverne
(74) *Attorney, Agent, or Firm*—Camoriano & Associates; Theresa Fritz Camoriano; Guillermo Camoriano

(57) ABSTRACT

A coupler device includes a hollow housing defining first and second openings, an electrical path through the housing, and a physical block including a potting material that surrounds the electrical path and fills the space between the electrical path and the housing.

15 Claims, 9 Drawing Sheets

HAZARDOUS AREA COUPLER DEVICE

BACKGROUND

The present invention relates to a coupler device. More particularly, it relates to a coupler device for use in hazardous areas. Depending upon the type of electrical connector on the device, it may be used for coupling Ethernet/Serial/USB through the wall of a hazardous area enclosure.

FIG. 1 depicts the current code requirements for housing non-intrinsically-safe equipment in a hazardous area location, which include the mounting of such equipment in an explosion-proof hazardous area enclosure such as a NEMA 7 rated enclosure, and providing both an electrical barrier (this is essentially a high-tech circuit breaker), and a physical block in the form of a seal-fitting which is a certified flame-proof connection capable of withstanding a 6000 pounds per square inch (psi) hydrostatic test.

The cost, in both labor and material, of running explosion-proof conduit and of installing sealing devices, is very expensive, making the cost of installation in hazardous areas a major factor, often exceeding the cost of the equipment housed in the explosion-proof enclosure itself.

SUMMARY

The purpose of the present invention is to provide a prefabricated connector module that simply threads into the wall of the hazardous enclosure and permits a device inside the enclosure to be connected electrically to the outside of the enclosure. The prefabricated connector includes its own physical barrier or potted seal, so it eliminates the need for making a potted seal at the site, which greatly reduces labor costs while providing a much more consistent quality of potted seal.

DESCRIPTION

Figure 1:
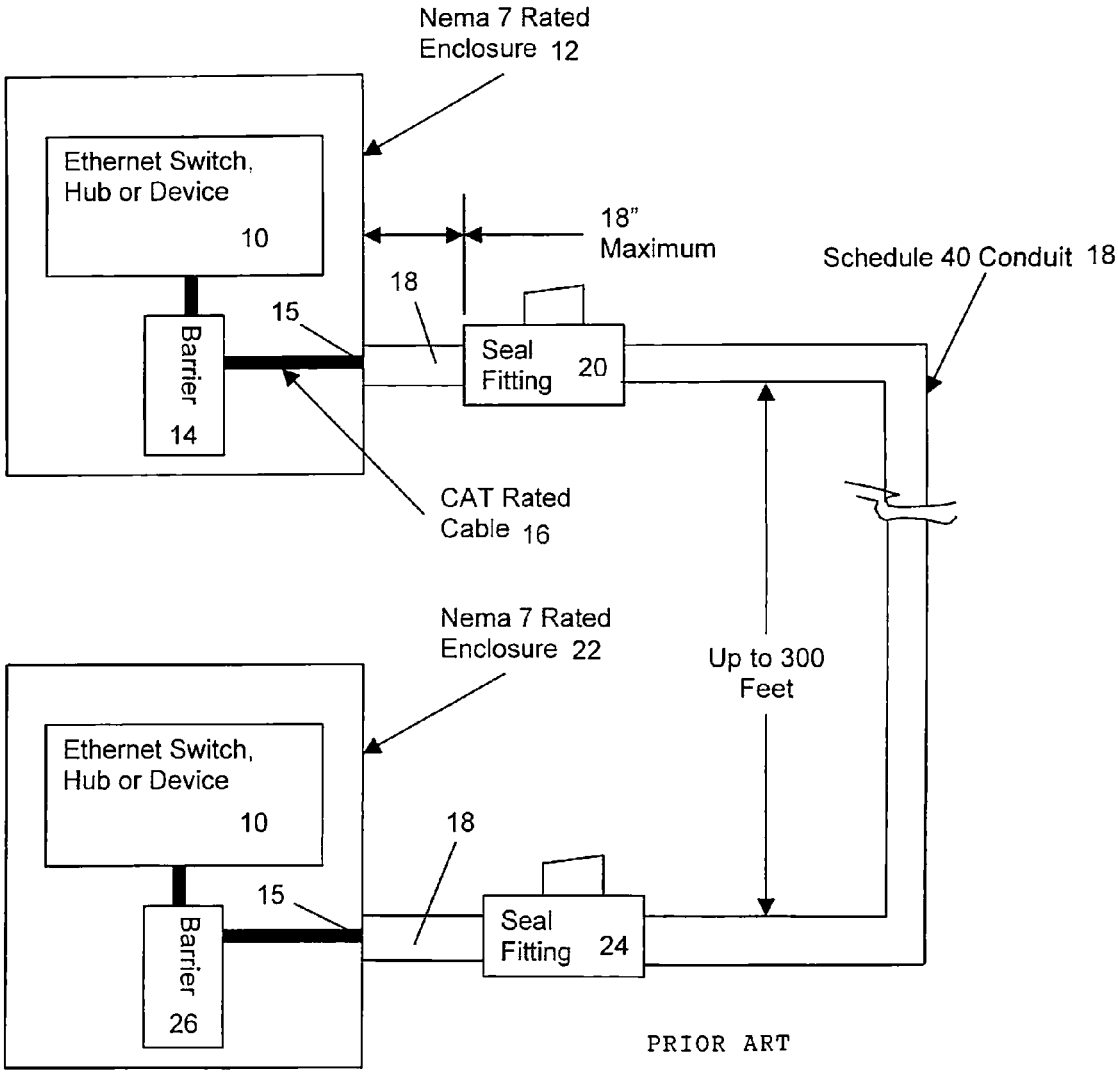
FIG. 1 is a schematic diagram of a typical prior art connection to an Ethernet hub or device in a hazardous area location.

FIG. 1 is a schematic diagram of a typical connection to an Ethernet switch, hub, or device 10 in a hazardous area location. The device 10 is mounted inside an explosion-proof enclosure 12, such as a NEMA 7 rated enclosure. An electrical barrier 14 inside the enclosure 12 controls the signal level including voltage, current, and power and ensures that the maximum voltage of the system will not exceed 6.2 volts. A CAT rated cable 16 extends from the electrical barrier 14 through an opening 15 in the wall of the enclosure 12.

A schedule 40 conduit 18 (with the CAT rated cable 16 inside the conduit 18) extends from this outlet opening 15 in the enclosure 12 to a seal fitting 20, which must terminate within 18 inches of the enclosure 12. The CAT rated cable 16 extends through the schedule 40 conduit 18, through the seal fitting 20, and through a second seal fitting 24 into a second explosion-proof enclosure 22 or to another enclosure outside the hazardous area location (that is, in a safe area location, not shown). A second seal fitting 24 and a second electrical barrier 26 are used when going into this second hazardous area enclosure 22.

This prior-art installation process is expensive and time consuming. Each seal fitting 20 is custom-made in the field. In order to make the seal fitting, the cable is extended through the fitting 20, and then a potting material approved as a potting compound for hazardous areas is poured into the fitting 20 and fills the space between the cable 16 and the fitting 20, and there is a time delay until the potting compound cures before the seal fitting 20 can be used. Care must be exercised in order to ensure that the seal fitting 20 is within 18 inches of the enclosure 12, the schedule 40 conduit 18 is cut and fit it to suit, and all the necessary hardware (including the electrical barrier 14, the seal fitting 20, the potting material for potting the seal fitting 20, and the lengths of schedule 40 conduit 18) must be kept at hand for the installation. Extra time must be taken by qualified personnel to double check that both the electrical barrier 14 and the physical block 20 are present and have been properly installed.

Figure 2:
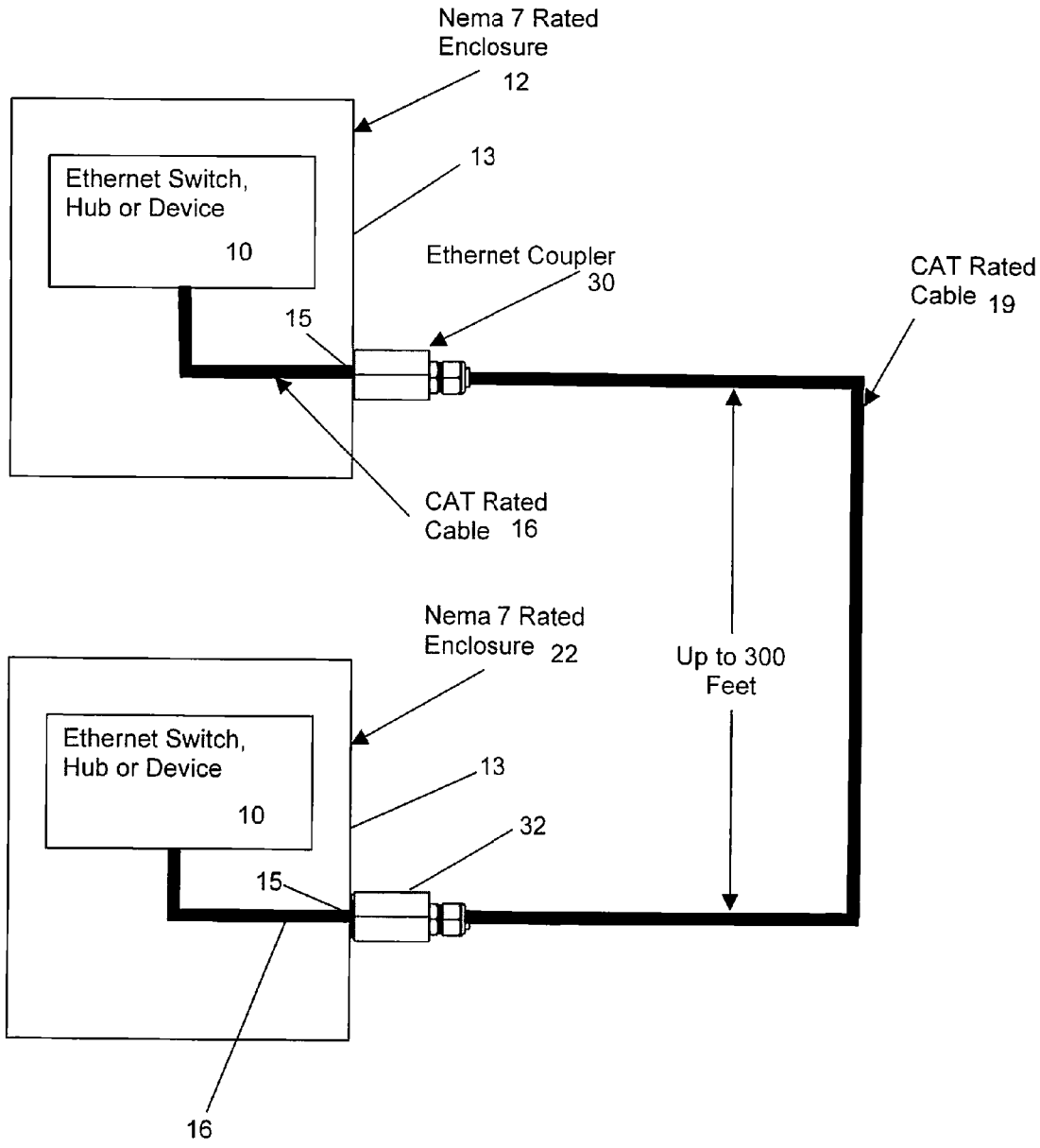
FIG. 2 is a is a schematic diagram of a connection to an Ethernet hub or device in a hazardous area location made in accordance with the present invention.

FIG. 2 depicts an example of one installation of an Ethernet device 10 in a hazardous area location using a hazardous area coupler device 30 made in accordance with the present invention. As is described in more detail below, the hazardous area coupler device 30 threads directly into the wall 13 of the NEMA rated enclosure 12 at the threaded opening 15, with a CAT rated cable 16 connecting directly between the Ethernet device 10 and the hazardous area coupler device 30. Another CAT rated cable 19 extends directly from the hazardous area coupler device 30 to a second hazardous area coupler device 32 at another explosion-proof enclosure 22 or to another enclosure outside the hazardous area location (that is, in a safe area location, not shown).

Figure 3:
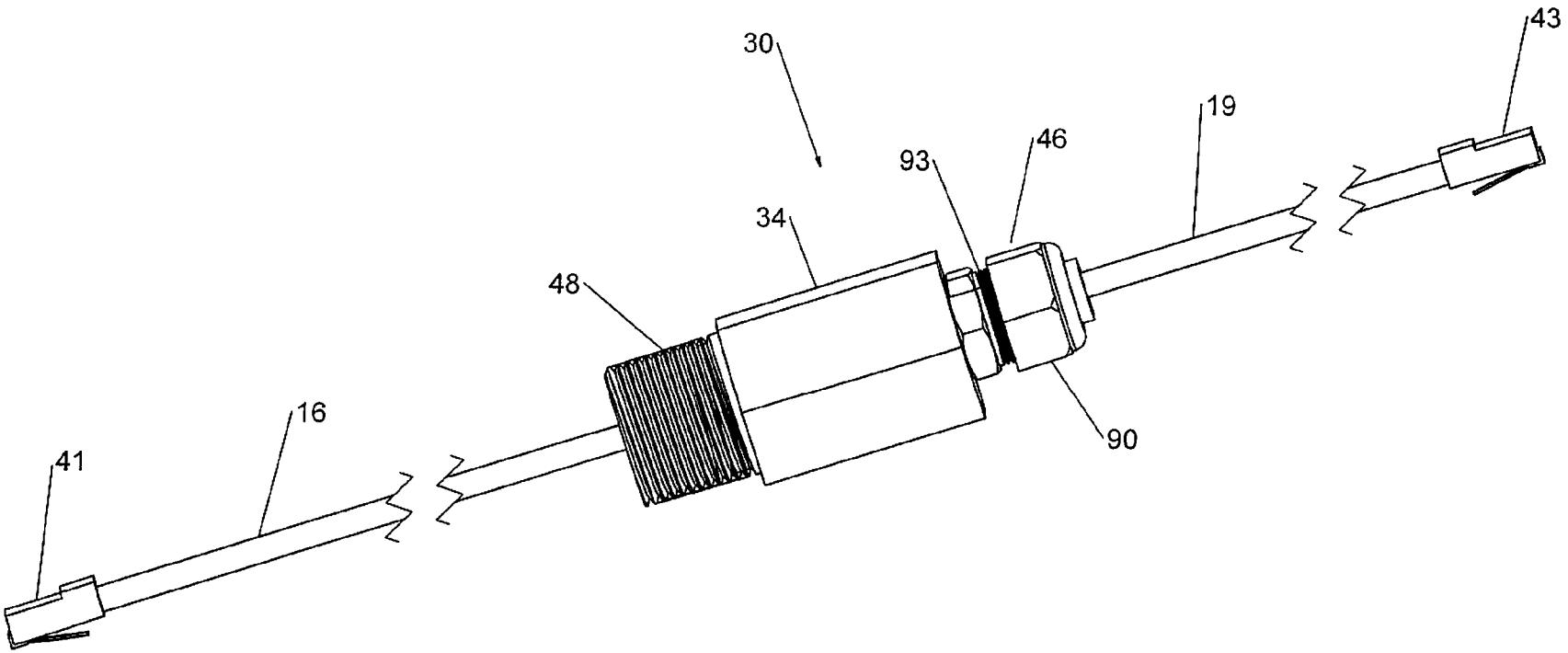
FIG. 3 is a perspective view of the Ethernet coupler of FIG. 2.
Figure 4:
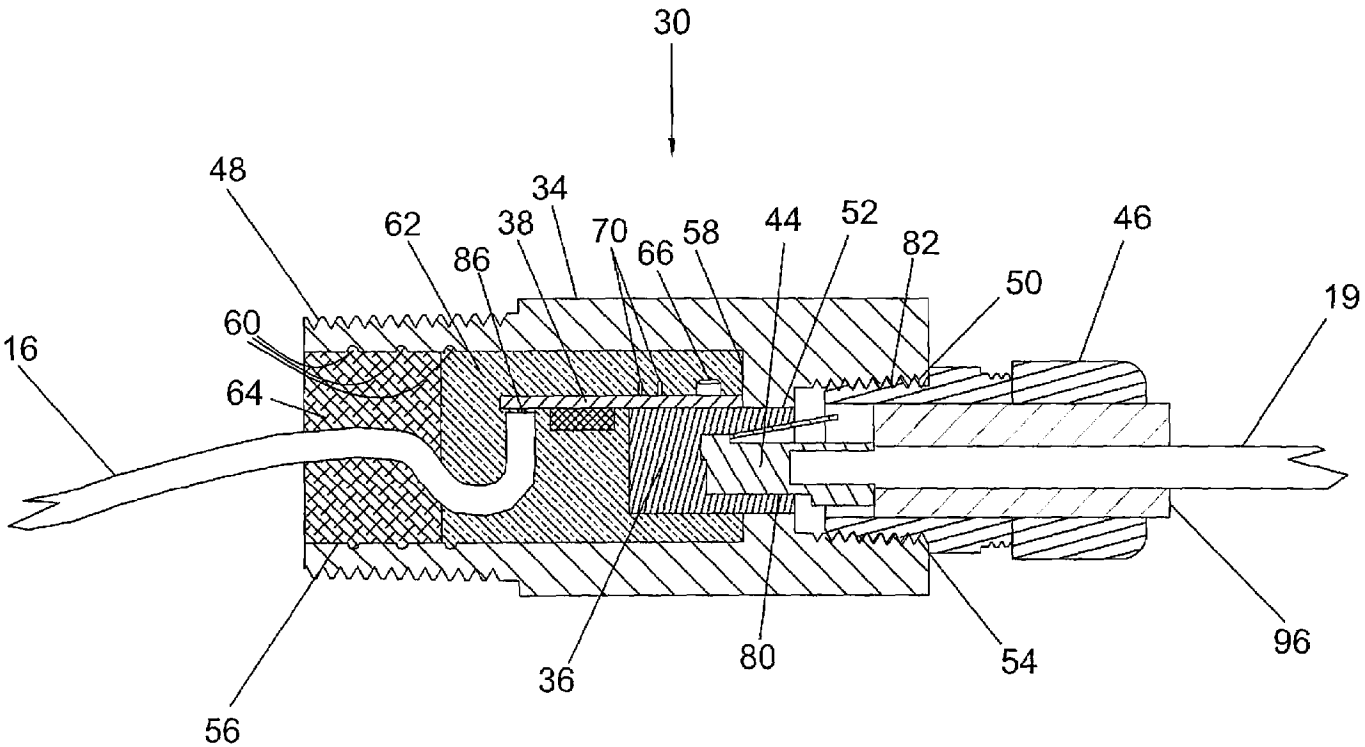
FIG. 4 is a sectional view of the Ethernet coupler of FIG. 3.
Figure 5:
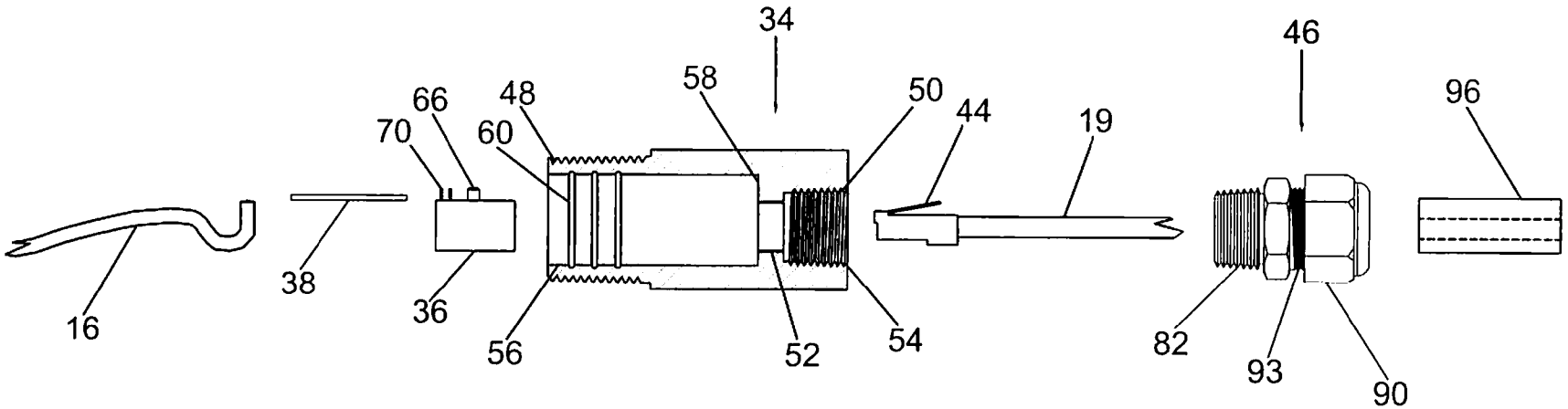
FIG. 5 is an exploded view of the Ethernet coupler of FIG. 3, partially in section.

FIGS. 3-5 depict one of the hazardous area coupler devices 30. Referring now to FIGS. 4 and 5, the hazardous area coupler device 30 includes an elongated housing element 34, having a generally hollow cylindrical shape. An RJ 45 receptacle connector 36, a circuit board 38, and a CAT rated cable 16 are housed inside the housing 34, as described in more detail below. Also included as part of this particular hazardous area coupler device 30 are another CAT rated cable 19 (including an Ethernet RJ coupler 44), and a weatherproof cable gland 46.

Figure 7:
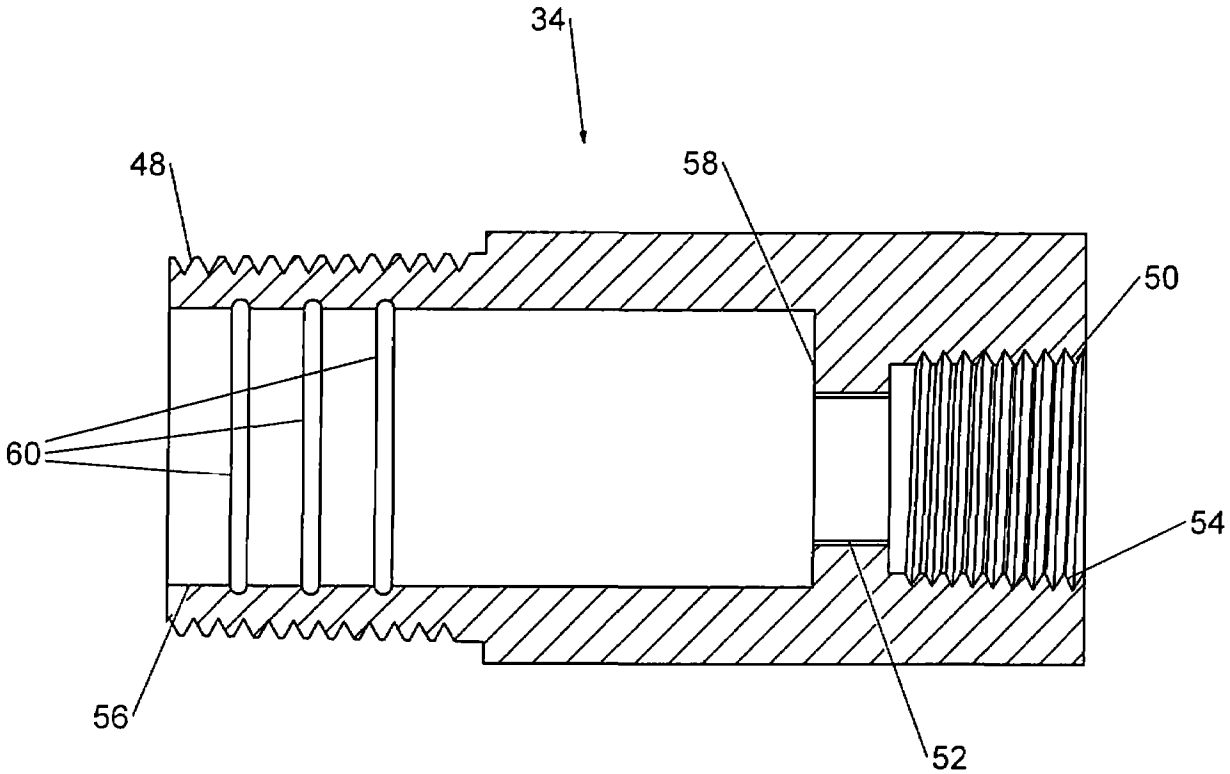
FIG. 7 is an enlarged sectional view of the housing of the coupler of FIG. 5.

Referring now to FIG. 7, the hollow, elongated element 34 is a stainless steel housing with an externally threaded first end 48, which forms an internally grooved cavity 56, and an internally threaded second end 50, which forms an internally threaded cavity 54. (The terms "first" and "second" as used herein are arbitrary and may be reversed in other parts of the description or claims.) A smaller diameter internal neck 52 separates the internally threaded cavity 54 (which accommodates the weatherproof cable gland 46) from the internally grooved cavity 56 (which accommodates the internally encapsulated and potted RJ 45 receptacle 36 and circuit board 38). As is best appreciated in FIG. 4, the neck 52 provides a radial support for the RJ 45 receptacle 36, and the shoulder 58 which divides the internally grooved cavity 56 and the neck 52 (see also FIG. 7) cooperates with one edge of the circuit board 38 to properly locate the RJ 45 receptacle 36 and circuit board 38 assembly within the cavity 56. As described in more detail later, the internal grooves 60 in the grooved cavity 56 provide enhanced anchoring points for the encapsulate material 62 and for the potting material 64.

Figure 8:
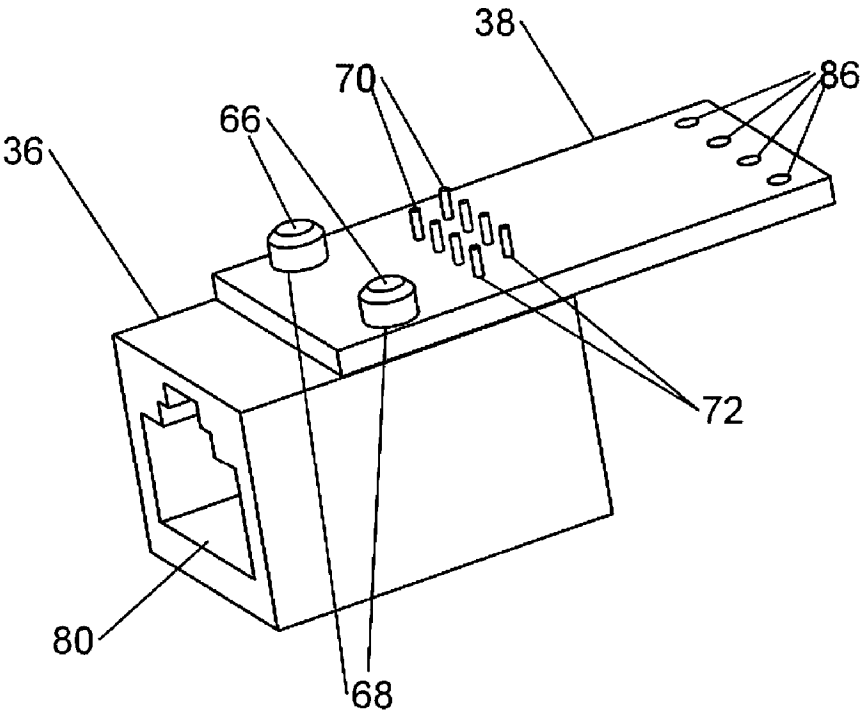
FIG. 8 is a perspective view of the RJ 45 receptacle and circuit board subassembly of FIG. 5.

As shown in FIG. 8, the RJ 45 receptacle 36 defines an RJ style jack 80, and includes two locating pins 66 which cooperate with two through-openings 68 in the circuit board 38 so as to properly align these two items 36, 38 during assembly. Likewise, the RJ 45 receptacle 36 includes two rows of circuit pins 70 which engage two rows of corresponding openings 72 in the circuit board 38. Once assembled, the circuit pins 70 are soldered to the openings 72 to ensure electrical continuity between these two items 36, 38. The RJ 45 receptacle 36 also has grounding tabs (not shown), which touch the shoulder 58 of the housing 34 to create an electrical path. As shown in FIG. 4, the wires at one end of the CAT rated cable 16 are also soldered to the circuit board 38 at some of the through openings 86.

Figure 9:
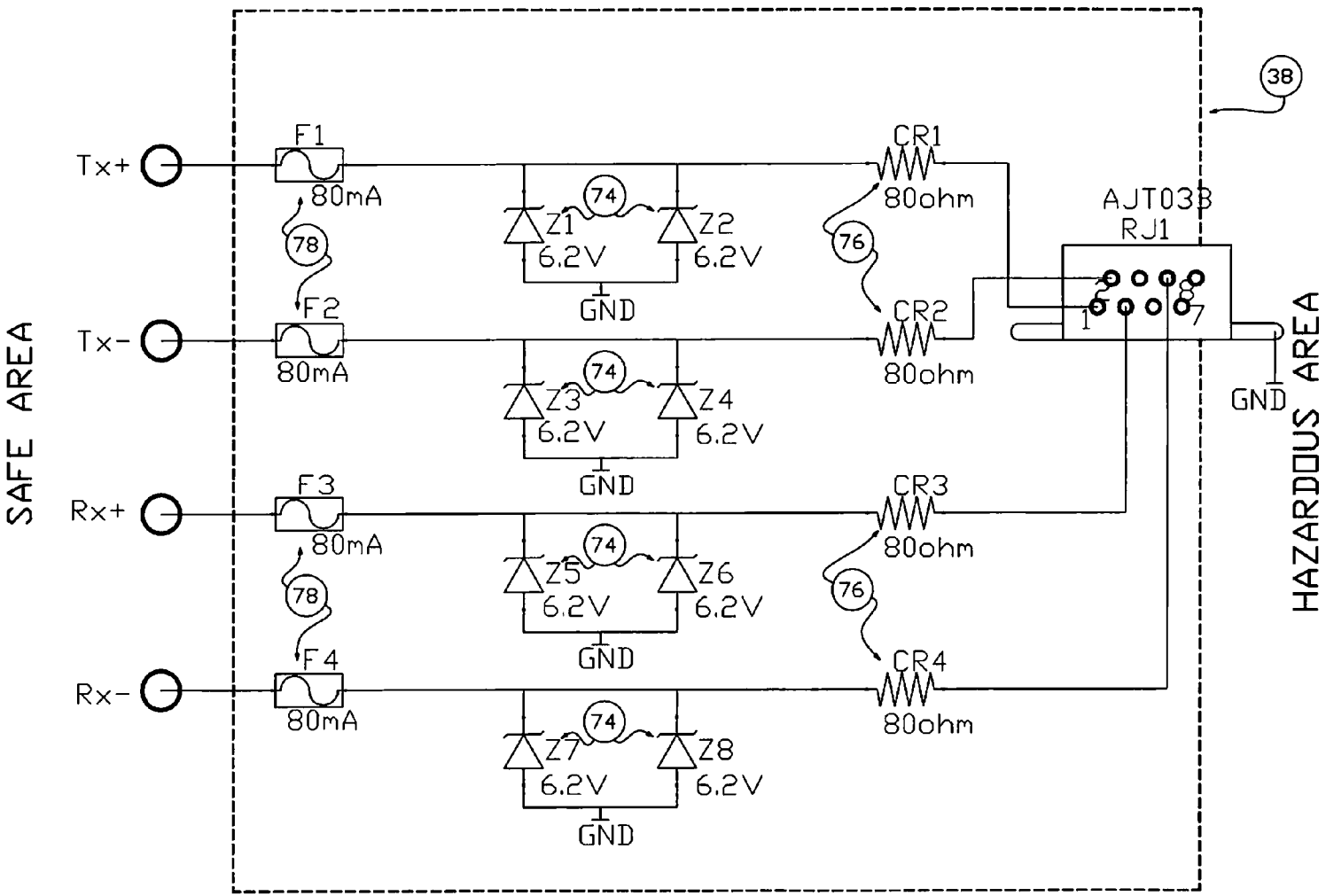
FIG. 9 is a schematic electrical diagram of the circuit board of FIG. 8.

FIG. 9 is a schematic electrical diagram of the circuitry in the circuit board 38, which provides the electrical isolation for a hazardous area connection. A typical Ethernet signal is between 2.3 and 3 volts. The Zenor circuitries 74 ensure that the maximum voltage of the circuit will not exceed 6.2 volts. The 80-ohm current limiting resistors 76 control the current through the circuit, limiting the current to a maximum of 275 milliamps. 80-milliamp fuses 78 are provided for protection in case of a current resistor failure. These are quick-blow resistors 78, which provide protection in an over-current situation. This Zenor-circuitry circuit board 38 is essentially a hi-tech circuit breaker/fuse box which prevents high voltage and which thus acts as the electrical barrier or isolation part of the hazardous area coupler device 30.

It should be noted that other electrical wiring configurations could be used that would also achieve the electrical barrier as required by the electrical code for hazardous area classification such as UL 913 (Underwriters Laboratories, Inc. standard 913). It should also be noted that the specific electrical wiring configuration, and more particularly the value or rating of some of the components, such as for the Zenor circuits 74, the resistors 76, and the fuses 78 may change for protection of a serial connector or of a USB connector or another type of connector instead of an Ethernet connector. Of course, the type of jack would also change, accordingly.

Referring to FIGS. 4 and 5, to assemble the hazardous area coupler device 30, the RJ 45 receptacle 36 is first assembled and soldered onto the circuit board 38. The CAT rated cable 16 is also soldered onto the circuit board 38, and this subassembly is inserted into the circumferentially-grooved cavity 56 of the housing 34 until the RJ 45 receptacle 36 extends through the neck 52, and one edge of the circuit board 38 abuts the shoulder 58 of the housing 34. This creates an electrical path from the receptacle 36 which is adjacent the internally-threaded end 50 of the coupler 30, through the circuit board 38 containing the electrical isolation circuitry, and through the cable 16, to the other end 48 of the coupler 30. The housing 34 is then oriented vertically, with the externally-threaded end 48 up, and a first potting material or encapsulate 62 is poured into the cavity 56, filling the space between the circuit board 38 and the housing 34 until the circuit board 38 is fully enclosed in the encapsulate 62, and the innermost circumferential groove 60 is filled. The encapsulate 62 is allowed to harden, and then a second potting material 64 is poured into the cavity 56 until it is substantially flush with the end of the housing 34, filling the space between the cable 16 and the housing 34 and filling the remaining circumferential grooves 60.

As may be seen in FIG. 4, the CAT rated cable 16 extends through the encapsulate material 62 and through the potting material 64. When the externally-threaded end 48 of the connector 30 is threaded into the threaded opening 15 in the wall 13 of the hazardous area enclosure, as shown in FIG. 2, the CAT rated cable 16 extends into the enclosure 12 and connects to a device 10, either by being hard-wired or through a connector. This CAT rated cable 16 typically extends approximately 30 inches from the end of the housing 34 to allow a connection to an Ethernet access point inside a "certified" enclosure within 30 inches of the hazardous area coupler device 30.

The encapsulate 62 and the potting 64 provide a strain relief for the CAT rated cable 16, and they provide a flameproof physical block (a seal off) capable of withstanding a 6,000 PSI hydrostatic test. The internal grooves 60 in the housing 34 provide mechanical anchoring points for the potting materials 62, 64 to be secured to the cavity 56 of the housing 34, which helps the hazardous area coupler device 30 withstand a 6,000 PSI hydrostatic test and thus properly defend against the propagation of an explosion through the device.

Since this device 30 is prefabricated in a factory under standard conditions, there can be greater assurance that it will meet the quality requirements for a hazardous area than in prior art situations in which the potted physical barrier is made in the field.

Figure 6:
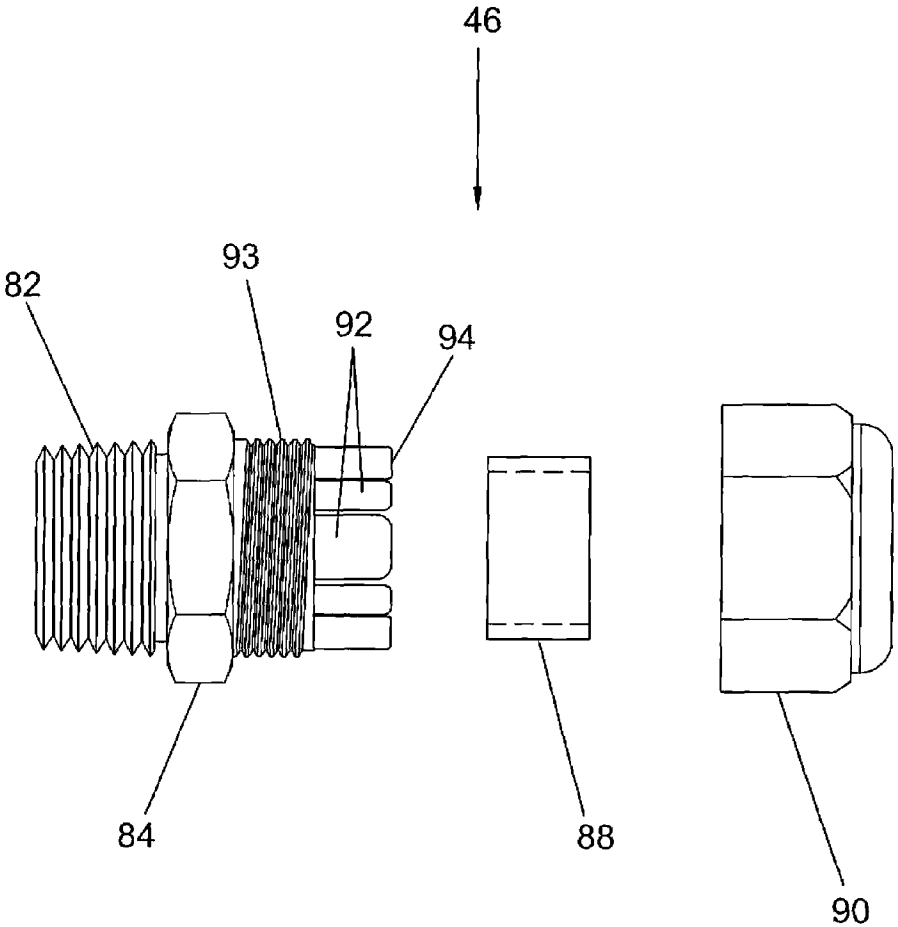
FIG. 6 is an exploded perspective view of a weatherproof cable gland used to protect the connection between a cable and the Ethernet coupler of FIGS. 4 and 5.

Referring now to FIGS. 4, 5, and 6, a CAT rated cable 19 is fed through a weatherproof cable gland 46 (described in more detail below), and the male RJ coupler 44 on the end of the cable 19 plugs into the RJ style jack 80 adjacent the outer end of the hazardous area coupler device 30. The weatherproof cable gland 46 slides over the CAT rated cable 19, and its external threads 82 are threaded into the internally threaded end 50 of the housing 34 to secure the weatherproof cable gland 46 to the housing 34.

Referring briefly to FIG. 6, the weatherproof cable gland 46 includes a collet 84, a rubber seal 88 and a nut 90. The collet 84 defines a plurality of wedge-shaped fingers 92 at its first end 94. The rubber seal 88 is installed inside the fingers 92 such that, when the nut 90 is threaded onto threads 93 at the first end 94 of the collet 84, the fingers 92 collapse inwardly and radially squeeze the rubber seal 88, which then grips around the cable 19 to form a waterproof seal. Note that a rubber sleeve 96 (See FIG. 5) may be installed over the cable 19 to assist in forming a watertight seal, as the rubber seal 88 has to be large enough to allow the RJ coupler 44 to go through it.

In a basic setup process, an installer would follow the following procedure:

1) Install a prefabricated hazardous area coupler device 30 into a threaded opening 15 in the wall 13 of a NEMA rated enclosure 12 by threading the externally-threaded end 48 of the hazardous area coupler device 30 into the threaded opening 15.

2) Plug the RJ style coupler 41 at the interior end (See FIG. 3) of the hazardous area coupler device 30 directly into the device 10 (which may be a switch, hub, computer, or other device).

3) Plug in the RJ style coupler 44 (See FIG. 5) of the CAT rated cable 19 into the RJ style jack 80 (See FIG. 8) adjacent the outer end 50 of the hazardous area coupler device 30.

4) Slide the weatherproof cable gland 46 over the CAT rated cable 19 and thread the threaded end 82 of the weatherproof cable gland 46 into the internally threaded end 50 of the hazardous area coupler device 30.

5) Tighten the nut 90 of the weatherproof cable gland 46 onto the threads 93, compressing the collet 84 to effect a watertight seal around the CAT rated cable 19.

6) The other end of the CAT rated cable 19 may then be run to another hazardous area coupler device 32 (See FIG. 2) where its RJ style coupler 43 (See FIG. 3) is plugged into the RJ style jack 80 of this other hazardous area coupler device 32.

While the specification refers largely to hazardous area connections using RJ style connectors, the same, or very similar, devices as those described in this application can be used for serial and for USB connected devices or for other types of connectors. Some of the types of connectors which may use this type of hazardous area coupler device include (but are not limited to) RS-232, RS-485, RS-422, USB, and Ethernet. Also, while the embodiment described above incorporates the electrical isolation into a circuit board within the coupler device 30, it would be possible to provide a separate electrical barrier inside the enclosure 12 instead of or in addition to the isolation circuitry in the circuit board.

It will be obvious to those skilled in the art that modifications may be made to the embodiments described above without departing from the scope of the present invention as claimed.

What is claimed is:

1. A device for making electrical connections in a hazardous area, comprising:

a hollow coupler housing defining a first threaded opening for securing the coupler housing to a hazardous area enclosure and defining a second opening;

an electrical connector adjacent said second opening;

an electrical path from said connector to said first threaded opening;

a potted physical block inside said housing between said electrical connector and said first threaded opening;

an isolation barrier within said electrical path; and potted physical blocks inside said housing between said isolation barrier and said first and second openings, respectively;

all of said potted physical blocks including a potting material that fills the space between said electrical path and said housing.

2. A device for making electrical connections in a hazardous area as recited in claim 1, wherein all of said potted physical blocks include means for withstanding a standard 6,000 psi hydrostatic test.

3. A device for making electrical connections in a hazardous area as recited in claim 2, wherein said housing defines at least one internal circumferential groove and potting material is received in said internal circumferential groove.

4. A device for making electrical connections in a hazardous area as recited in claim 3, wherein potting material fills the space between said electrical isolation barrier and said housing.

5. A device for making electrical connections in a hazardous area as recited in claim 1, wherein said connector is a receptacle.

6. A device for making electrical connections in a hazardous area as recited in claim 5, and further comprising an electrical cable having a male connector at one end that mates with said receptacle and a weatherproof cable gland which surrounds said electrical cable and mates with said second opening.

7. A device for making electrical connections in a hazardous area as recited in claim 6, wherein said receptacle is an RJ 45 style receptacle.

8. A device for making electrical connections in a hazardous area, comprising:

a housing defining a first threaded end, a second threaded end, at least one internal circumferential groove; and a cavity in communication with said first and second threaded ends and said circumferential groove;

a circuit board including current-limiting circuitry housed inside said cavity between said first and second ends;

a cable connector receptacle in electrical communication with said circuit board, said cable connector receptacle located adjacent said first threaded end;

a cable in electrical communication with said circuit board, said cable extending through said second threaded end; and potting material surrounding said cable and filling in the space between said cable and said housing, including filling said circumferential groove;

said potting material providing physical blocks between said circuit board and said first and second threaded ends.

9. A device for making electrical connections in a hazardous area as recited in claim 8, wherein potting material also fills the space between said circuit board and said housing.

10. A method for making an electrical connection through the wall of a hazardous area enclosure, comprising the steps of:

providing a hazardous area enclosure including a wall having an exterior side and an interior side, and defining a threaded opening through said wall extending from the interior side to the exterior side; and threading a first threaded end of a prefabricated electrical coupler device into said threaded opening, wherein said prefabricated electrical coupler device comprises a housing defining a first threaded end and a second end; an electrical path inside said housing extending from said first threaded end to said second end, including an electrical isolation barrier in said electrical path; and a potting material surrounding said electrical path, said potting material forming a physical blocks between said electrical isolation barrier and said first and second ends, said physical blocks including means for withstanding a 6,000 psi hydrostatic test.

11. A method for making an electrical connection through the wall of a hazardous area enclosure as recited in claim 10, and then further comprising the steps of connecting a device on the interior side of said wall to said electrical path adjacent said first threaded end.

12. A method for making an electrical connection through the wall of a hazardous area enclosure as recited in claim 10, wherein said electrical path includes an electrical connector adjacent said second end, and further comprising the step of connecting to that electrical connector from the exterior side of the wall.

13. A method for making an electrical connection as recited in claim 12, wherein said electrical isolation barrier comprises a circuit board including current-limiting circuitry between said first threaded end and said second end.

14. A method for connecting a device in a hazardous area classification as recited in claim 11, and further comprising the steps of:

providing an electrical connector receptacle on said prefabricated electrical coupling device adjacent said second end;

providing a waterproof cable gland at said second end of said housing; and extending a cable through said cable gland and connecting said cable to said electrical path through said electrical connector receptacle.

15. A method for connecting a device in a hazardous area classification as recited in claim 14, wherein said housing defines at least one circumferential groove and said potting material extends into said groove.

* * * * *